US008510956B2

(12) United States Patent
Rehbein et al.

(10) Patent No.: US 8,510,956 B2
(45) Date of Patent: Aug. 20, 2013

(54) COMBINATION SHAVING AND TRIMMING DEVICE

(75) Inventors: Stefan Rehbein, Bad Soden am Taunus (DE); Cirilo Javier Perez Lopez, Eschborn (DE); Gerrit Roenneberg, Darmstadt (DE); Michael Maichel, Frankfurt am Main (DE)

(73) Assignee: The Gillette Company, Boston, MA (US)

( * ) Notice: Subject to any disclaimer, the term of this patent is extended or adjusted under 35 U.S.C. 154(b) by 481 days.

(21) Appl. No.: 12/722,840

(22) Filed: Mar. 12, 2010

(65) Prior Publication Data

US 2011/0219620 A1 Sep. 15, 2011

(51) Int. Cl.
*B26B 21/40* (2006.01)
*B26B 19/38* (2006.01)

(52) U.S. Cl.
USPC ..... 30/34.1; 30/34.05; 30/50; 30/122

(58) Field of Classification Search
USPC ..... 30/34.05, 34.1, 50, 122, 123, 537
See application file for complete search history.

(56) References Cited

U.S. PATENT DOCUMENTS

| | | | | |
|---|---|---|---|---|
| 3,222,781 | A | 12/1965 | Luther et al. | |
| 3,552,007 | A | 1/1971 | Yamada | |
| 4,249,307 | A | 2/1981 | Andis | |
| 4,422,237 | A * | 12/1983 | Trotta | 30/526 |
| 4,581,822 | A | 4/1986 | Fujimura | |
| 4,614,032 | A | 9/1986 | Szabo | |
| 4,631,825 | A | 12/1986 | Kuriyama et al. | |
| 4,694,575 | A | 9/1987 | Boerger | |
| 4,908,945 | A * | 3/1990 | Jacobson | 30/41 |
| 4,914,816 | A * | 4/1990 | Fenn et al. | 30/45 |
| 4,980,973 | A | 1/1991 | Lee et al. | |
| 5,046,249 | A | 9/1991 | Kawara et al. | |
| 5,299,354 | A | 4/1994 | Metcalf et al. | |
| 5,325,590 | A | 7/1994 | Andis et al. | |
| 5,386,631 | A | 2/1995 | Van Asten et al. | |
| 5,542,178 | A | 8/1996 | Harkleroad | |
| 5,761,813 | A * | 6/1998 | Frick et al. | 30/41 |
| 5,956,851 | A * | 9/1999 | Apprille et al. | 30/47 |
| 6,044,558 | A | 4/2000 | Wu | |
| 6,052,905 | A | 4/2000 | Branchinelli et al. | |
| D426,918 | S | 6/2000 | Greene | |
| D431,095 | S | 9/2000 | Hyman | |
| 6,112,421 | A | 9/2000 | Greene | |
| D432,265 | S | 10/2000 | Kling et al. | |
| 6,192,586 | B1 * | 2/2001 | Metcalf et al. | 30/47 |

(Continued)

FOREIGN PATENT DOCUMENTS

WO WO 94/04326 A1 3/1994

OTHER PUBLICATIONS

U.S. Appl. No. 12/816,712, filed Jun. 16, 2010, Perez-Lopez et al.
U.S. Appl. No. 29/369,832, filed Sep. 14, 2010, Schulz et al.

(Continued)

*Primary Examiner* — Hwei C Payer
(74) *Attorney, Agent, or Firm* — Jay A. Krebs

(57) ABSTRACT

A combination shaving and trimming device includes a handle having an upper end and lower end, a powered trimmer disposed adjacent the upper end, a wet-shaving razor attachment adapted for mounting over the trimmer onto the upper end of the handle. The wet-shaving razor attachment is removably connected to the trimmer via a releasable locking mechanism.

14 Claims, 11 Drawing Sheets

(56) References Cited

U.S. PATENT DOCUMENTS

| | | | | |
|---|---|---|---|---|
| D445,541 | S | | 7/2001 | Wursthorn |
| D446,351 | S | | 8/2001 | Greene |
| 6,378,210 | B1 | | 4/2002 | Bickford |
| D475,806 | S | | 6/2003 | Yang |
| 6,604,287 | B2 | | 8/2003 | Melton et al. |
| D481,169 | S | | 10/2003 | Cheung |
| D486,267 | S | | 2/2004 | Goetschi |
| 6,862,810 | B2 | | 3/2005 | Braun et al. |
| D509,026 | S | | 8/2005 | Leventhal et al. |
| 6,928,738 | B2 | | 8/2005 | Segrea |
| D512,795 | S | | 12/2005 | Carpenter |
| D513,343 | S | | 12/2005 | Bokelman-Dumas |
| D514,256 | S | | 1/2006 | Bokelman-Dumas |
| 7,028,405 | B2 | | 4/2006 | Paas et al. |
| D521,683 | S | | 5/2006 | Pepall |
| 7,103,980 | B2 | | 9/2006 | Leventhal |
| D534,315 | S | | 12/2006 | Provost et al. |
| D534,686 | S | | 1/2007 | Provost et al. |
| D539,478 | S | | 3/2007 | Leventhal et al. |
| D560,309 | S | | 1/2008 | Garland et al. |
| D563,045 | S | | 2/2008 | Provost et al. |
| D563,046 | S | | 2/2008 | Provost et al. |
| D568,534 | S | | 5/2008 | Micinilio et al. |
| D568,537 | S | | 5/2008 | Micinilio et al. |
| D568,539 | S | | 5/2008 | Micinilio et al. |
| D568,540 | S | | 5/2008 | Micinilio et al. |
| D568,541 | S | | 5/2008 | Micinilio |
| D571,954 | S | | 6/2008 | Kling et al. |
| D571,955 | S | | 6/2008 | Wonderley et al. |
| D577,864 | S | | 9/2008 | Kitagawa et al. |
| D591,451 | S | | 4/2009 | Micinilio et al. |
| D591,453 | S | | 4/2009 | Micinilio et al. |
| 7,536,787 | B2 | | 5/2009 | Blaustein et al. |
| D600,408 | S | | 9/2009 | Micinilio et al. |
| D604,014 | S | | 11/2009 | Micinilio et al. |
| D607,151 | S | * | 12/2009 | Kling et al. ..... D28/48 |
| D624,702 | S | | 9/2010 | Schulz |
| D628,744 | S | | 12/2010 | Goetschi |
| 7,900,359 | B2 | * | 3/2011 | Royle ..... 30/34.1 |
| D636,126 | S | * | 4/2011 | Schulz et al. ..... D28/53 |
| D663,896 | S | * | 7/2012 | Meech et al. ..... D28/49 |
| 8,209,868 | B2 | * | 7/2012 | Schnak et al. ..... 30/45 |
| 2004/0158990 | A1 | | 8/2004 | Heide |
| 2004/0181954 | A1 | | 9/2004 | Follo et al. |
| 2005/0005453 | A1 | | 1/2005 | Egeresi |
| 2005/0246902 | A1 | | 11/2005 | Poran |
| 2007/0006463 | A1 | | 1/2007 | Pennella |
| 2007/0283567 | A1 | | 12/2007 | Magli |
| 2008/0000089 | A1 | | 1/2008 | Pennella et al. |
| 2008/0016691 | A1 | | 1/2008 | Pennella et al. |
| 2008/0034591 | A1 | | 2/2008 | Fung |
| 2008/0047145 | A1 | | 2/2008 | Dietzel et al. |
| 2008/0086887 | A1 | | 4/2008 | Park et al. |
| 2008/0110034 | A1 | * | 5/2008 | Schnak et al. ..... 30/526 |
| 2009/0000124 | A1 | | 1/2009 | Micinilio et al. |
| 2009/0000125 | A1 | | 1/2009 | Peyser et al. |
| 2009/0165304 | A1 | | 7/2009 | Blaustein et al. |
| 2010/0011585 | A1 | | 1/2010 | Maichel et al. |
| 2010/0037463 | A1 | | 2/2010 | Maichel et al. |
| 2010/0064520 | A1 | | 3/2010 | Park et al. |
| 2010/0139097 | A1 | | 6/2010 | Perez-Lopez et al. |
| 2010/0299927 | A1 | * | 12/2010 | Fischer et al. ..... 30/34.1 |
| 2011/0214289 | A1 | * | 9/2011 | Maichel et al. ..... 30/29.5 |

OTHER PUBLICATIONS

U.S. Appl. No. 29/369,831, filed Sep. 14, 2010, Schulz et al.
U.S. Appl. No. 29/368,796, filed Aug. 30, 2010, Meech et al.
U.S. Appl. No. 29/364,548, filed Jun. 24, 2010, Kalinowsky et al.

* cited by examiner

COMBINATION SHAVING AND TRIMMING DEVICE

FIELD OF THE INVENTION

The invention relates to a combination shaving and trimming device. More particularly, the present invention relates to a locking mechanism connecting a wet shaving razor attachment to a trimmer device.

BACKGROUND OF THE INVENTION

Most consumers find that dealing with multiple tools like a razor, scissors and an electric trimmer every time you want to change the look of your facial hair can be a real hassle. Grooming devices providing both shaving and trimming are known in the art; however, such devices are often bulky and can be difficult to use. For instance, grooming devices having both electric trimming blades and wet shaving blades located on the same end of the device as disclosed in U.S. Pat. No. 7,536,787 can pose an obstructed view. For instance, the wet shaving blade may obstruct the user's view as he uses the trimmer to trim side burns, mustache, or other facial hair. Thus, there is a need for a shaving and trimming device having a removable shaving component such as a connecting member having one end attaching to a wet shaving razor blade cartridge and another end attaching to the trimmer.

The connecting member between trimmer and wet shaving razor blade cartridge has to fulfill several requirements. The structure has to be firm and secure during wet-shaving usage to transfer all forces and movements of the trimmer handle onto the wet shaving cartridge. Specifically, unintended disengaging of the attachment has to be avoided in order to prevent injuries. The structure has to be easily attachable and removable for the consumer to switch between wet-shaving and trimming applications. The structure has to be able to withstand an impact force in case the trimmer with wet-shaving attachment is dropped during use in order to prevent damage to the cartridge. In some combinations, the wet shaving and grooming device is designed such that the structure transfers vibrations generated from the trimmer handle into the wet shaving attachment. This requires a firm fit without any play or clearance between the parts that would result in loss of amplitude and possibly produce a rattling noise.

There is a need to provide a combination shaving and trimming device including a connecting member that is easily attachable and removable for the consumer and include a locking feature that not only secures the connecting member during use but is releasable so that the connecting member detaches from the trimmer under impact in case the device is dropped.

SUMMARY OF THE INVENTION

A combination shaving and trimming device is provided comprising a battery operated trimmer and wet-shaving razor attachment removably connected to the trimmer via a releasable locking mechanism. The trimmer comprises a handle having an upper end and lower end, a front side and a back side. A powered trimmer blade and trimmer housing are disposed adjacent the upper end. The trimmer housing includes an overhanging edge on the front side of the handle beneath the trimmer blade providing at least one first connection for the wet shaving razor attachment. The handle includes a slot on the back side of the handle between the upper end and lower end and more proximate to the upper end. The slot includes a forward side toward the upper end of the handle and an aft side toward the lower end of the handle. The forward side of the slot includes an overhanging lip which interfaces with the wet shaving razor attachment providing a second connection releasably attaching the handle to the wet-shaving razor attachment.

The wet-shaving razor attachment comprises a connecting member having a forward end and an aft end, a front face and a back face. The forward end of the connecting member includes an overhanging shoulder on the front face releasably attaching to the overhanging edge of the trimmer housing and a connection for a wet shaving razor cartridge. The aft end of the connecting member includes at least one hook on the front face having a latching surface which releasably attaches to the overhanging lip on the forward side of the slot in the handle.

In one embodiment, a spring loaded slider is disposed on the back side of the handle proximate the upper end with the aforementioned slot disposed in the spring loaded slider. The spring loaded slider includes a spring that biases back and forth linear movement of the slider along the length of the handle and produces biasing force between the overhanging lip on the forward side of the slot the latching surface of the hook on the aft end of the connecting member.

In another embodiment of the combination shaving and trimming device, the connecting member of the wet-shaving razor attachment includes a connecting member having a forward end and a resilient flexible aft end. The forward end includes an overhanging shoulder on the front face releasably attaching to the overhanging edge of the trimmer housing and the resilient flexible aft end comprises a hook on the front face releasably attaching to the slot in the handle. The hook includes a latching surface which is biased against the overhanging lip of the slot by the resilient flexible aft end of the connecting member. For this embodiment the resilient aft end can include a molded elastic element attached to the aft end of the connecting member. In another embodiment, the connecting member comprises a hard plastic and the aft end is partially separated from the forward end by discontinuous slots in opposing sides of the connecting member forming an integral strip of hard plastic connecting the aft end to the forward end of the connecting member. The integral strip of hard plastic provides a resilient flexible aft end.

DETAILED DESCRIPTION OF THE INVENTION

Figure 1C:
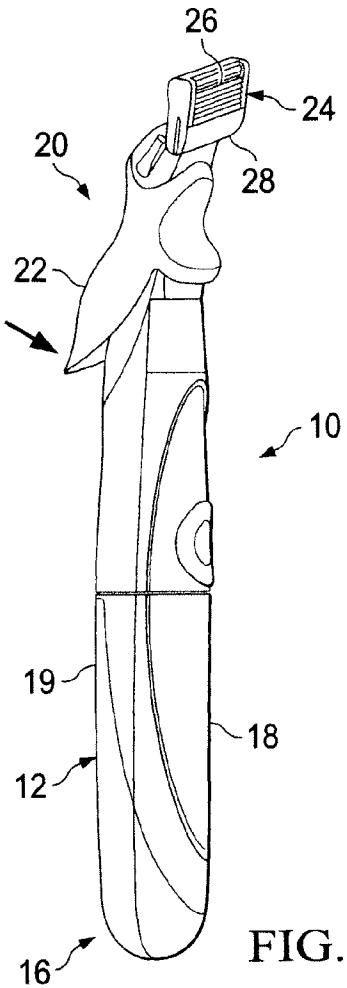
FIGS. 1*a*-1*c* are a perspective views of the combination shaving and trimming device illustrating the installation of the wet shaving razor attachment.
Figure 1B:
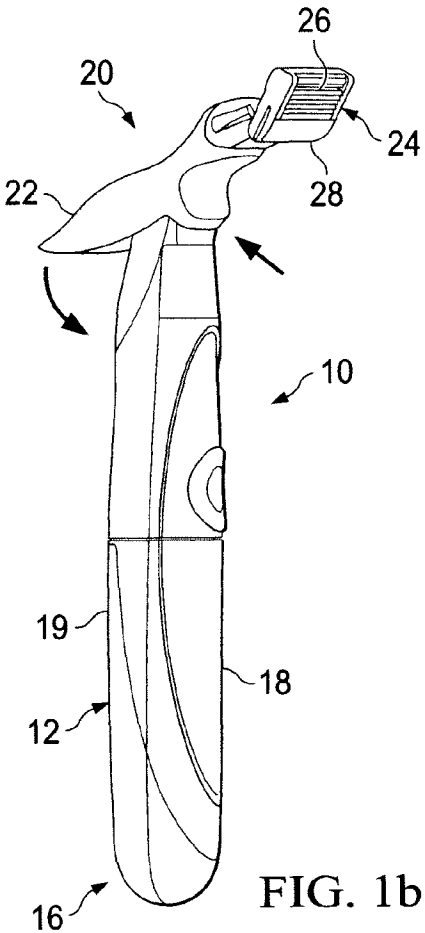
Figure 1A:
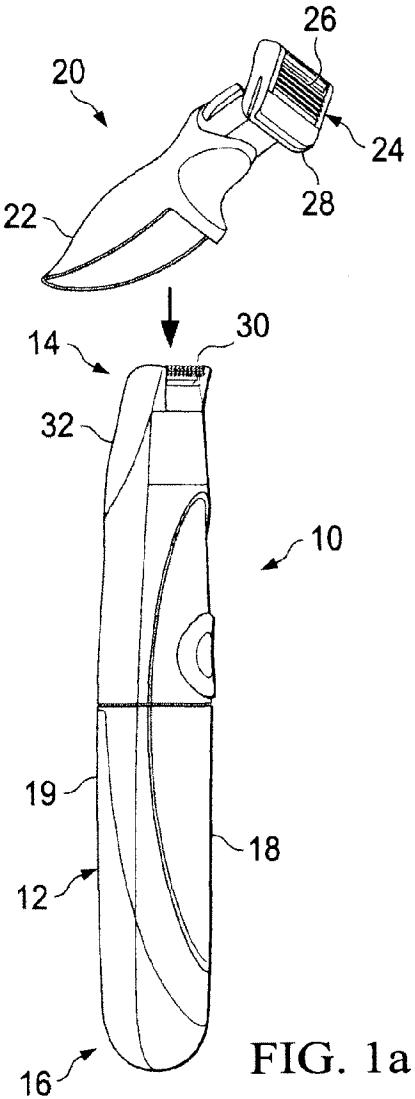

FIGS. 1*a*-1*c* show a combination shaving and trimming device 10. The device 10 includes a handle 12, a powered trimmer 30, and a wet-shaving razor attachment 20 removably connected to the trimmer 30. The handle 12 has an upper end 14 and lower end 16, a front side 18 and a back side 19. The trimmer 30 is located at or near upper end 14 on the front side 18 and is configured for moving at least one trimming blade, which may be serrated, and wherein this trimming blade is disposed within the trimmer 30. In certain embodiments, there may be more than one trimming blade disposed in a stacked position wherein at least one reciprocates against the other to effect a trimming or cutting action on hair that is placed adjacent to a cutting edge of the one or more trimming blades. A trimmer housing 32 is disposed adjacent the upper end 14 near the trimmer 30.

The wet-shaving razor attachment 20 includes connecting member 22 and razor cartridge 24. The connecting member 22 is adapted for mounting over the trimmer 30 onto the handle 12. The razor cartridge 24 engagably mates with the connecting member 22. In the embodiment of FIG. 1*a-c*, the razor cartridge 24 is removably attached to the connecting member 22. The razor cartridge 24 includes one or more blades 26 mounted within a housing 28 of the cartridge 24. The device 10 is configured to operate as a trimming device, as shown in FIG. 1*a*, with the wet shaving razor attachment 20 completely removed, or as a wet-shaving device with the wet shaving attachment 20 removably attached to upper end 14. FIGS. 1*b* and 1*c* illustrate the progression of the assembly of the wet shaving razor attachment 20 to the handle 12. The combination shaving and trimming device 10 can function as a powered wet-shaving device by actuating trimmer 30 while the wet shaving razor attachment 20 is assembled on the handle 12 such that the resulting vibration from moving the at least one trimming blade translates vibration to the razor attachment 20.

In another embodiment (not shown), the wet-shaving razor attachment 20 includes an ejection mechanism for removably attaching the razor cartridge 24 from the connecting member 22. In yet another embodiment, the razor cartridge 24 includes one or more razor blades on a front surface and at least one blade disposed substantially perpendicular to the front surface. The razor cartridge 24 can be of the type disclosed in U.S. Pat. No. 7,669,335 to Vincent Walker and assigned to The Gillette Company.

Figure 9:
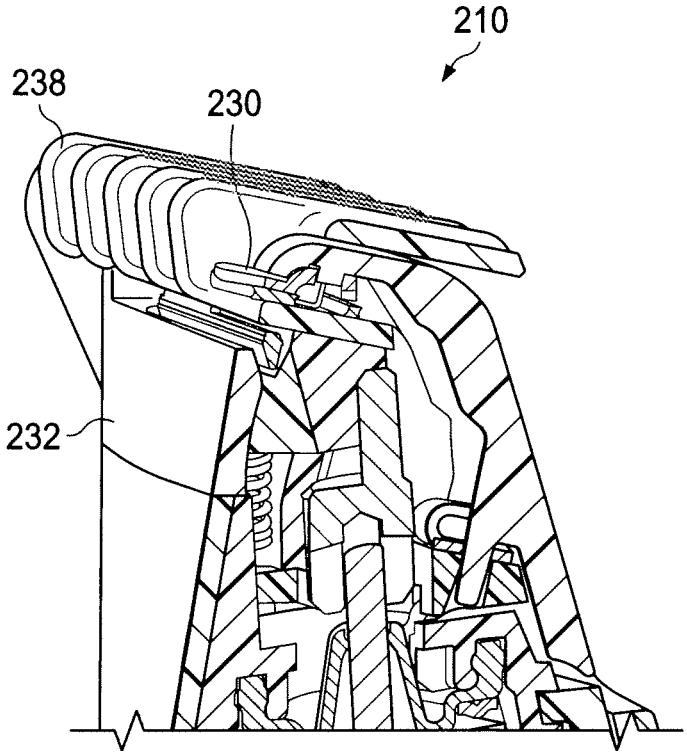
FIG. 9 shows a partial cross-sectional view of a combination wet shaving and trimming device with a trimmer comb attached.

In another embodiment, comb attachments for trimming hair to a desired length may be assembled to the trimming device 210 when the wet shaving razor attachment is completely removed. As shown in FIG. 9, comb attachment 238 can be configured to attach to the trimmer housing 232 using some or all of the same connecting features used for the wet shaving razor attachment.

In the embodiment shown in FIGS. 2*a*-2*d*, the trimmer housing 32 includes at least one overhanging edge 34 disposed on the front side 18 of the trimmer 30. In an alternate embodiment, the trimmer housing can include two spaced apart overhanging edges 34 disposed on the front side 18 on opposite sides of the trimmer 30 which is to the left and right of the trimmer 30. A spring loaded slider 40 is disposed proximate the upper end 14 on the back side 19 of the handle 12 providing a releasable connection for the wet shaving razor attachment 20. The spring loaded slider 40 includes a slot 42 having a forward side 44 and an aft side 46. The forward side 44 of the slot 42 includes an overhanging lip 48. The spring loaded slider 40 includes a spring 70 that biases linear movement of the slider 40 in forward and aft directions. In the embodiment shown in FIGS. 2*a* and 2*c*, the spring 70 is located near the forward side 44 of the slot 42. However, in alternate embodiment shown in FIG. 3 fully described below, the spring 170 is located near the aft side 146 of the slot 142.

Figure 2A:
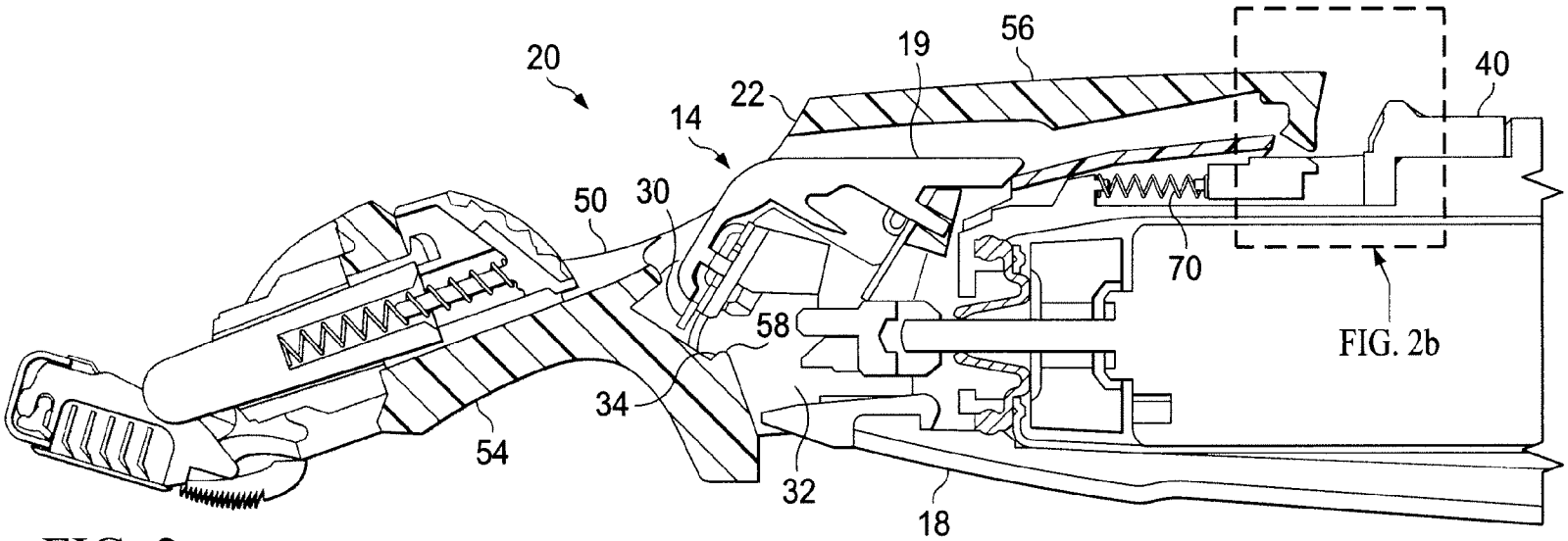
FIGS. 2*a*-2*d* are cross section views of the combination wet shaving and trimming device showing the locking mechanism for the wet shaving razor attachment.
Figure 2B:
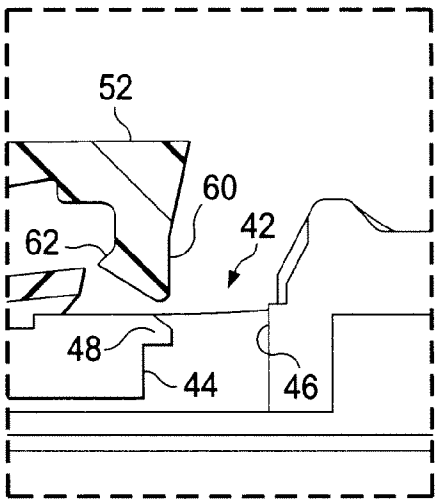
Figure 2C:
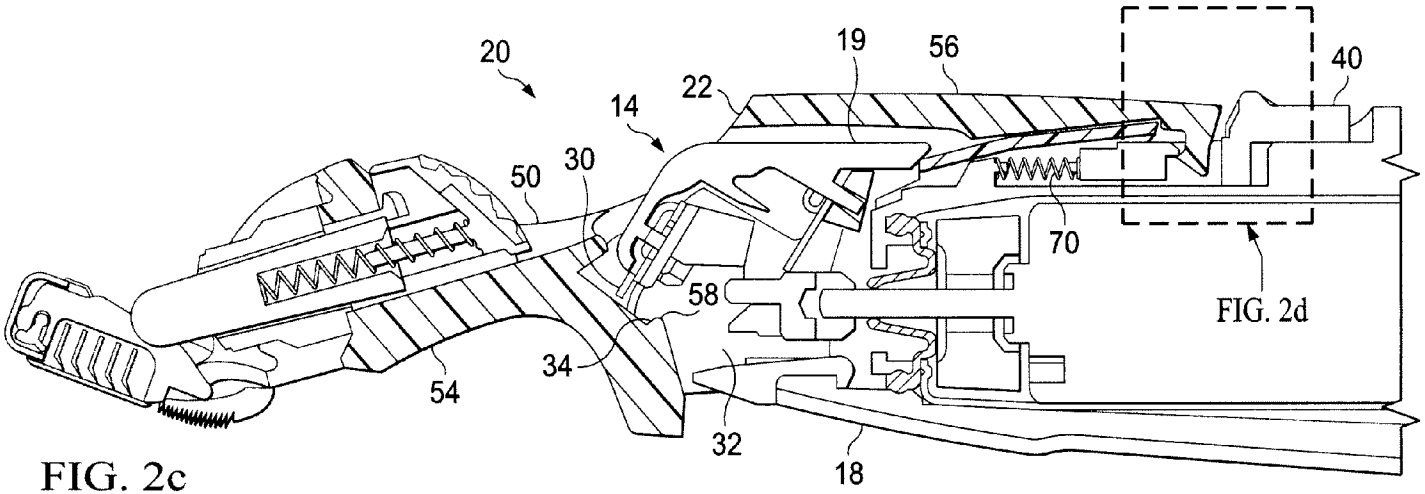
Figure 2D:
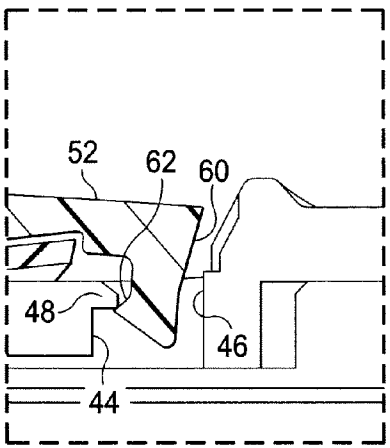

The wet-shaving razor attachment 20 comprises a connecting member 22 having a forward end 50 and an aft end 52; a front face 54 and a back face 56. The connecting member 22 includes an overhanging shoulder 58 disposed on the front face 54 proximate the forward end 50. The overhanging shoulder 58 releasably attaches to the overhanging edge 34 of the trimmer housing 32. At least one hook 60 is disposed on the front face 54 of the connecting member 22 at the aft end 52. The hook 60 includes a latching surface 62. As shown in FIGS. 2*b* and 2*d*, the hook 60 releasably attaches to the slot 42 in the spring loaded slider 40 such that the latching surface 62 abuts the overhanging lip 48 on the forward side 44 of the slot 42. An audible click is produced while attaching the hook 60 of the connecting member 22 to the overhanging lip 48 on the forward side 44 of the slot 42. In an alternate embodiment not shown, the connecting member can include two or more hooks disposed at the aft end of the connecting member.

In the embodiment shown in FIGS. 2*a*-2*d*, the latching surface 62 is angled so that the spring force produced by the spring 70 attached to the slider 40 pulls the connecting member 22 into a close fitting relationship with the handle 12. The combination of the angled configuration of the latching surface 62 and spring loaded slider 40 also allows the connecting member 22 to disengage under excessive force such as a sudden impact produced as a result of dropping the device 10. Allowing the connecting member 22 to separate from the handle 12 under such force can save the connecting member 22 from breaking in case the device is accidently dropped during use.

Figure 3:
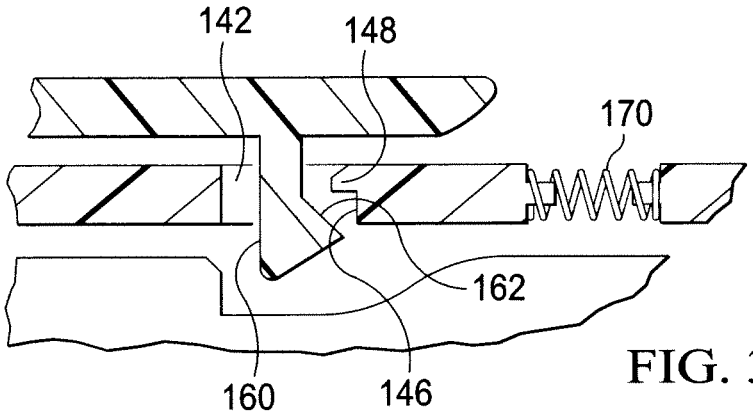
FIG. 3 is a cross section of an alternate embodiment of the locking mechanism shown in FIGS. 2*a*-2*d*.

In the alternate embodiment shown in FIG. 3 where the spring 170 is located near the aft side 146 of the slot 142, the hook 160 and corresponding latching surface 162 are oriented toward the aft side 146 of the slot 142. In this embodiment, the aft side 146 of the slot 142 includes the overhanging lip 148 which interfaces with latching surface 162 on hook 160.

Figure 4A:
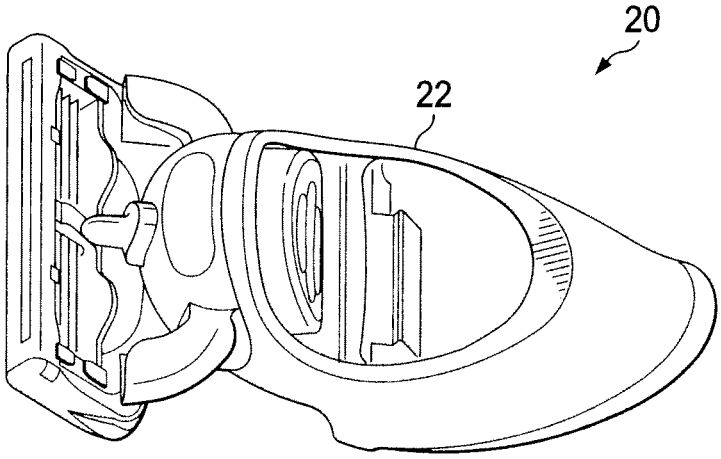
FIGS. 4*a*-4*c* are perspective views of the wet shaving razor attachment.
Figure 4B:
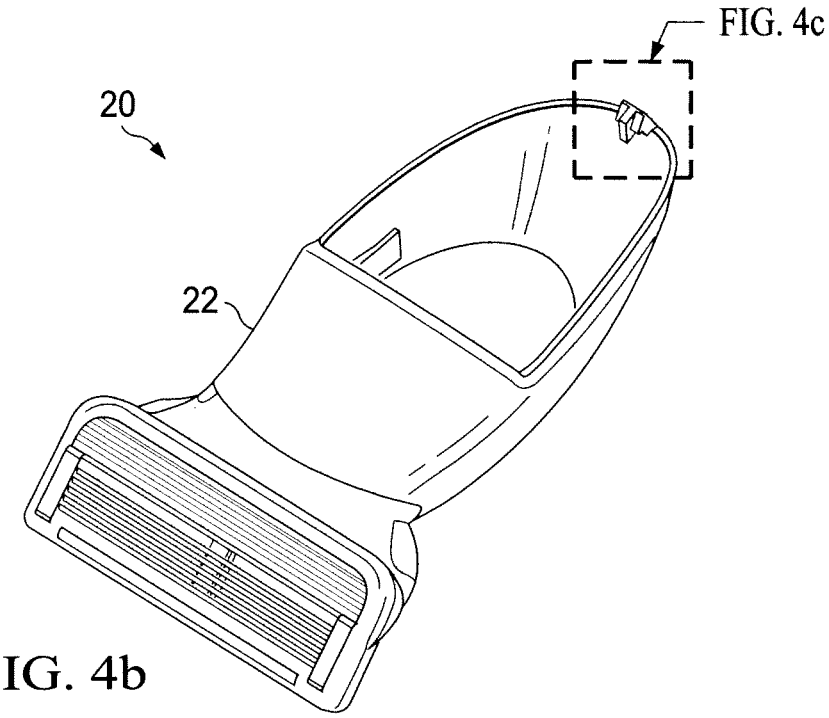
Figure 4C:
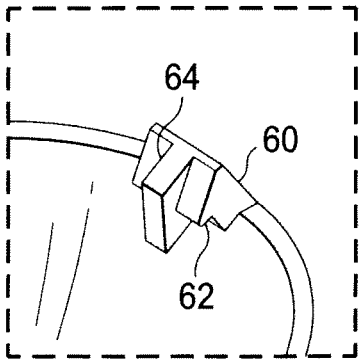
Figure 5:
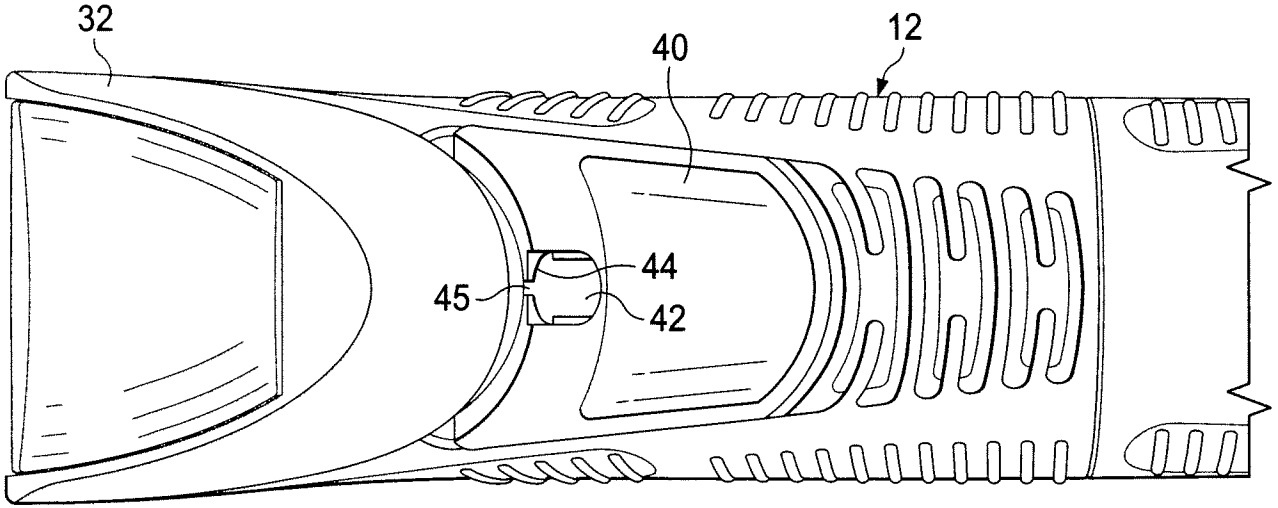
FIG. 5 is a top view of a trimmer embodiment according to the present invention.
Figure 6A:
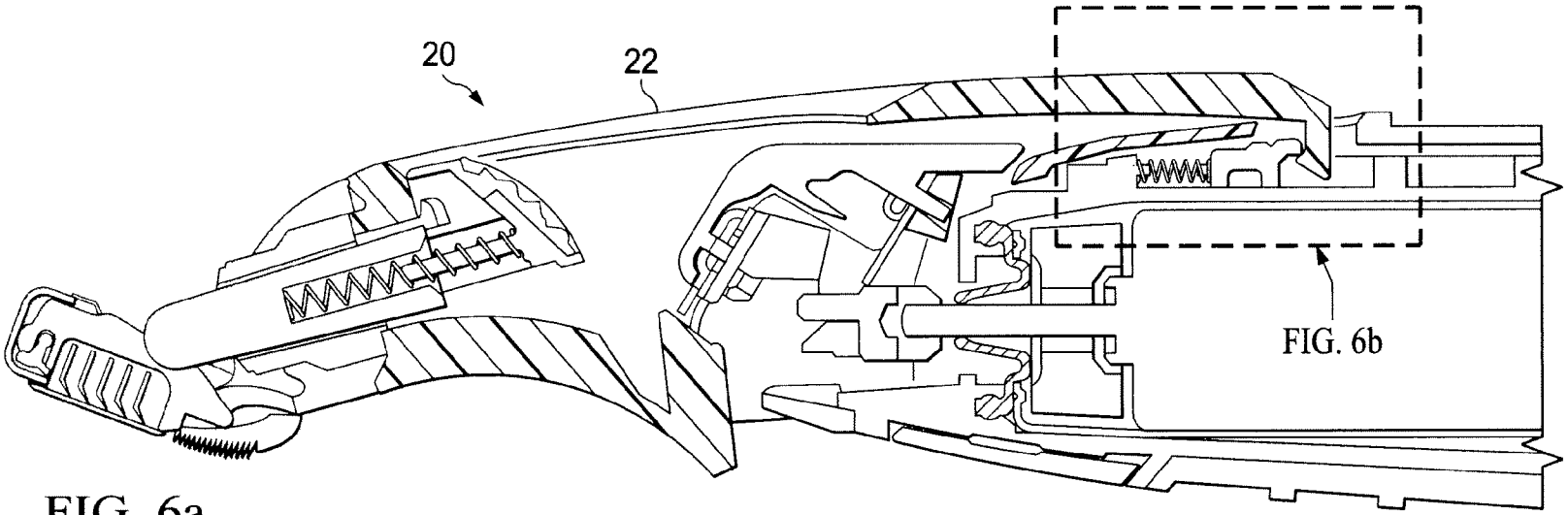
FIGS. 6*a* and 6*b* are cross section views of a locking mechanism for the trimmer embodiment shown in FIG. 5.
Figure 6B:
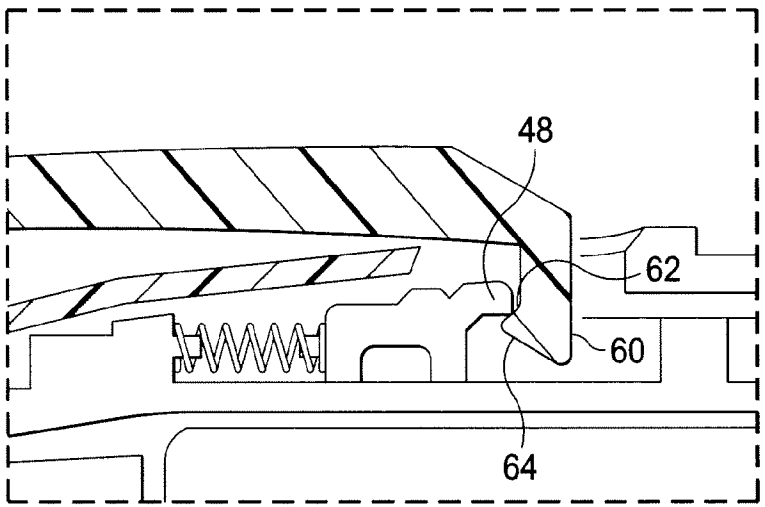

In one embodiment shown in FIGS. 4*a*-4*c*, the hook 60 on the connecting member 22 includes a rib 64 that limits movement of the connecting member 22 during normal use (i.e. shaving, removing a cartridge from the connecting member, etc.). The rib 64 is disposed in the middle of the forward face of the hook 60. For this embodiment, the slot 42 in spring loaded slider 40 shown in FIG. 5 includes a channel 45 in the forward side 44 of the slot 42 to accommodate the rib 64. The channel 45 is oriented perpendicular to the forward side 44 of the slot 42. FIGS. 6*a* and 6*b* show the wet shaving razor attachment 20 including the connecting member 22 and hook 60 with the rib 64 releasably attached to the slot 42 and channel 45 shown in FIG. 5.

In an alternate embodiment shown in FIG. 7*a*-7*d*, the connecting member 222 can be configured to provide the biased releasable connection between the connecting member 222 and the handle 212. For this embodiment, the handle 212 is configured with the slot 242 disposed directly in the back side 219 of the handle 212 proximate the upper end 214 without a spring loaded slider. Similar to the slider configuration previously described, the slot 242 in the handle 212 includes a forward side 244 and an aft side 246. The forward side of the slot includes an overhanging lip 248. The connecting member 222 includes a front face 254 and a back face 256 and a forward end 250 and a resilient flexible aft end 252. An overhanging shoulder 258 is disposed on the front face 254 proximate the forward end 250. The overhanging shoulder 258 releasably attaches to at least one overhanging edge 234 of the trimmer housing 232 on the front side 218 of the handle 212. Preferably, the overhanging shoulder 258 releasably attaches to two overhanging edges 234 of the trimmer housing 232 disposed on opposite sides of the trimmer 230. A hook 260 is disposed on the front face 254 at the resilient flexible aft end 252. The hook 260 includes a forward facing latching surface 262, wherein the hook 260 releasably attaches to the slot 242 in the back side 219 of the handle 212. The latching surface 262 is biased against the overhanging lip 248 on the forward side 244 of the slot 242 by the resilient flexible aft end 252.

Figure 7A:
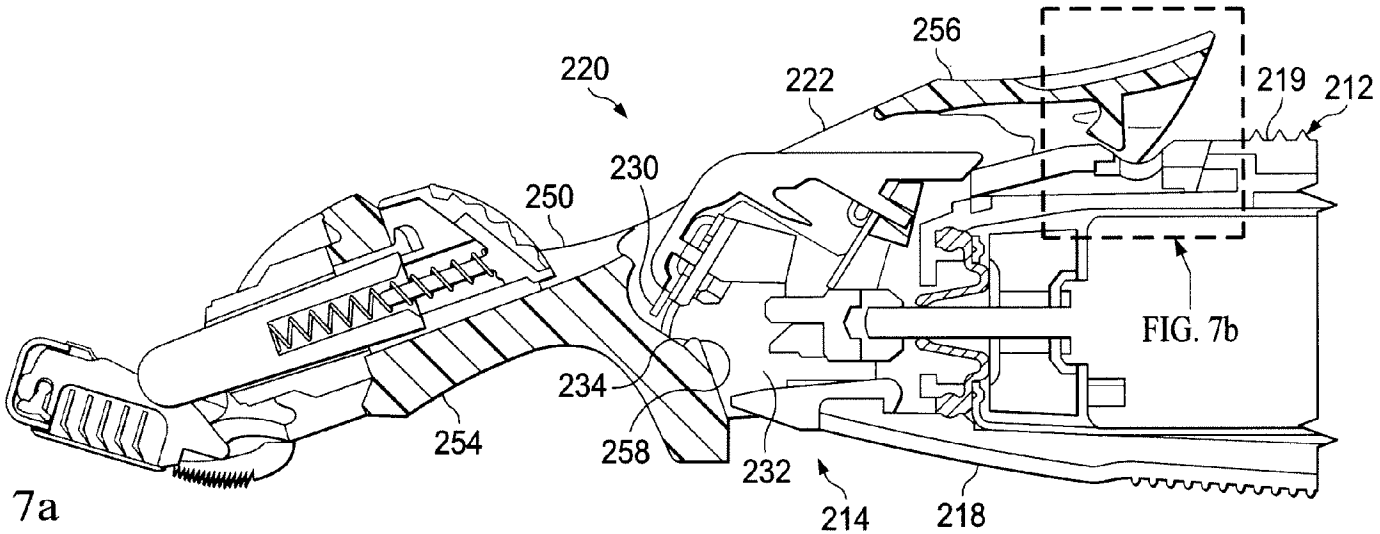
FIGS. 7*a*-7*d* are cross sections of alternate embodiments of the wet shaving razor attachment.
Figure 7B:
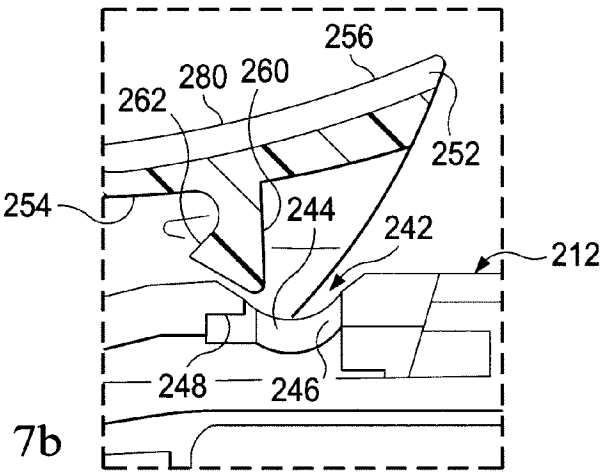
Figure 7C:
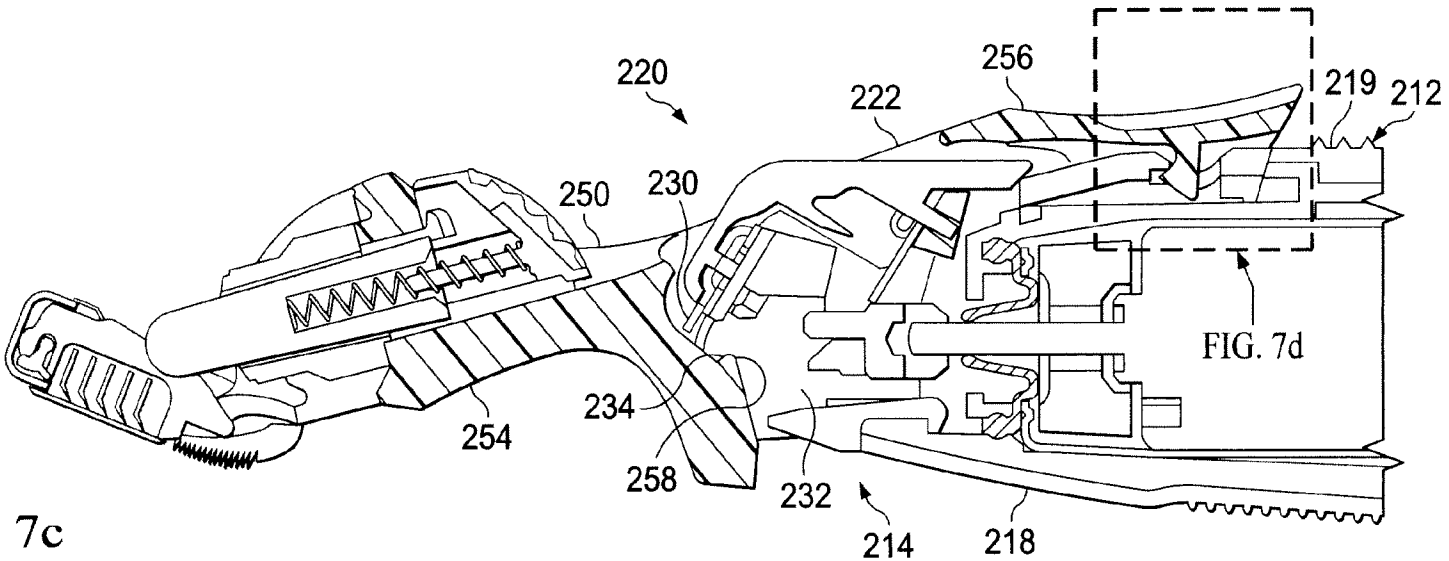
Figure 7D:
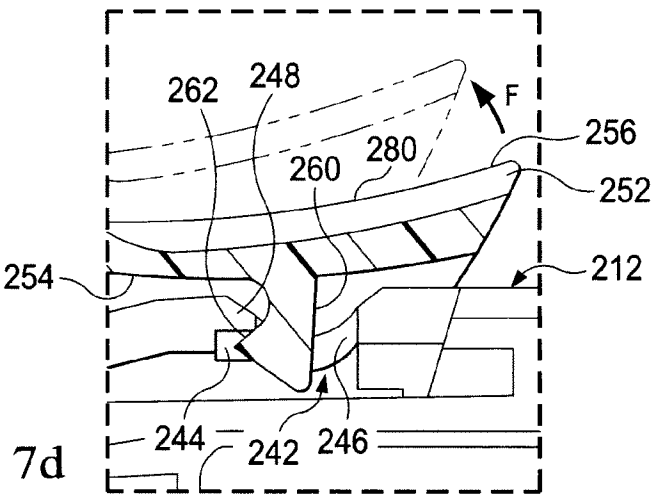

For this embodiment, the resilient aft end 252 of the connecting member 222 can include molded elastic element 280 attached to the back face 256 of the connecting member 222 as shown in FIG. 7*a*-7*d*. The molded elastic element 280 provides resilient flexibility necessary for releasable attachment between the connecting member 222 and the handle 212. As shown in FIG. 7*d*, the connecting member 222 is removed by applying force F to the resilient aft end 252 of the connecting member 222.

Figure 8A:
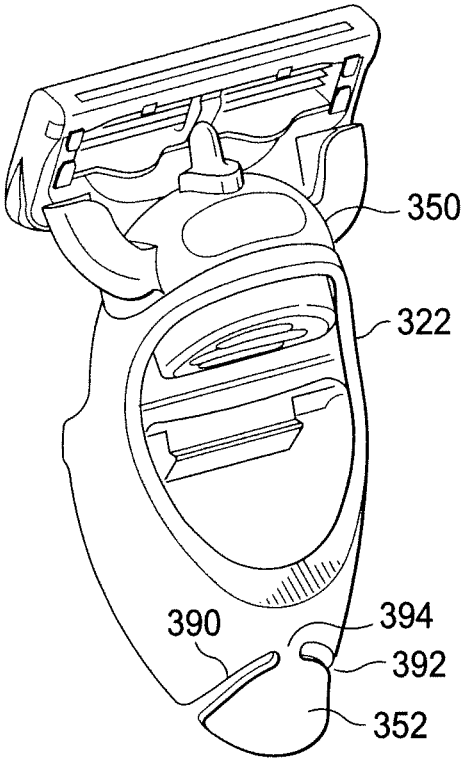
FIGS. 8*a* and 8*b* are perspective views of alternate embodiments of the wet shaving razor attachment.
Figure 8B:
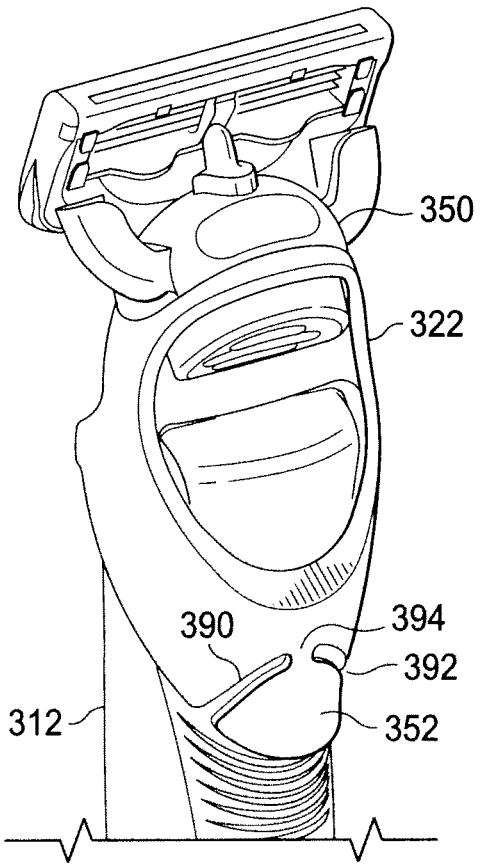

In an alternate embodiment shown in FIGS. 8*a* and 8*b*, the connecting member 322 can be composed of a hard plastic and the resilient aft end 352 can be configured to be resiliently flexible. In the embodiment shown in FIG. 8*a*, the aft end 352 is partially separated from the forward end 350 by discontinuous slots 390, 392 in opposing sides of the connecting member 322 forming an integral strip 394 of hard plastic connecting the aft end 352 to the forward end 350 of the connecting member 322. The integral strip 394 of hard plastic forms a resilient flexible aft end 352 enabling the aft end 352 and corresponding hook (not shown) to deflect during removable attachment of the connecting member 322 to the handle 312 as shown in FIG. 8*b*.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A combination shaving and trimming device comprising:

a handle having an upper end and a lower end comprising:

a powered trimmer blade disposed adjacent the upper end;

a trimmer housing disposed adjacent the upper end having at least one overhanging edge disposed proximate the powered trimmer blade; and a slot disposed in the handle proximate the upper end, the slot having a forward side and an aft side, the forward side including an overhanging lip; and a wet-shaving razor attachment comprising:

a connecting member having a forward end and an aft end, the connecting member comprising:

an overhanging shoulder disposed proximate the forward end, releasably attaching to the at least one overhanging edge of the trimmer housing; and at least one hook disposed at the aft end, the hook includes a latching surface, wherein the hook releasably attaches to the slot in the handle, wherein the latching surface is biased against the overhanging lip on the forward side of the slot; and a razor cartridge attached to the forward end of the connecting member.

2. The device of claim 1 wherein the latching surface and the hook are angled to pull the connecting member into a close fitting relationship with the handle and to allow the connecting member to disengage under excessive force induced by dropping the device.

3. The device of claim 1 wherein the hook includes a rib that limits movement of the connecting member during normal use.

4. The device of claim 1 wherein an audible click is produced while attaching the hook of the connecting member to the overhanging lip on the forward side of the slot.

5. The device of claim 1 wherein the razor cartridge is removably attached to the forward end of the connecting member.

6. The device of claim 1 wherein two overhanging edges are disposed on the trimmer housing on opposite sides of the powered trimmer blade.

7. The device of claim 1 further comprising at least one trimmer comb releasably attaching to the at least one overhanging edge of the trimmer housing when the wet shaving razor attachment is removed.

8. A combination shaving and trimming device comprising:

a handle having an upper end and a lower end comprising:

a powered trimmer blade disposed adjacent the upper end;

a trimmer housing disposed adjacent the upper end having at least one overhanging edge disposed proximate the powered trimmer blade; and a spring loaded slider proximate the upper end, the spring loaded slider comprising:

a spring, biasing linear movement of the slider in forward and aft directions; and a slot having a forward side and an aft side, the forward side including an overhanging lip;

and a wet-shaving razor attachment comprising:

a connecting member having a forward end and an aft end, the connecting member comprising:

an overhanging shoulder disposed proximate the forward end, releasably attaching to the at least one overhanging edge of the trimmer housing; and a hook disposed at the aft end, the hook includes a latching surface, wherein the hook releasably attaches to the slot in the spring loaded slider, wherein the latching surface is biased against the overhanging lip on the forward side of the slot;

and a razor cartridge attached to the forward end of the connecting member.

9. The device of claim 8 wherein the latching surface and the hook are angled to pull the connecting member into a close fitting relationship with the handle and to allow the connecting member to disengage under excessive force induced by dropping the device.

10. The device of claim 8 wherein the hook includes a rib that limits movement of the connecting member during normal use.

11. The device of claim 8 wherein two overhanging edges are disposed on the trimmer housing to the left and right of the powered trimmer blade.

12. The device of claim 8 wherein the force produced by the spring loaded slider on the hook and the latching surface of the connecting member produces an audible click during attachment.

13. The device of claim 8 wherein the razor cartridge is removably attached to the forward end of the connecting member.

14. The device of claim 8 wherein the wet-shaving razor attachment further comprises an ejection mechanism for detaching the razor cartridge from the connecting member.

* * * * *